US011428454B2

(12) United States Patent
Choi et al.

(10) Patent No.: US 11,428,454 B2
(45) Date of Patent: Aug. 30, 2022

(54) REFRIGERATOR

(71) Applicant: LG Electronics Inc., Seoul (KR)

(72) Inventors: Hyun Choi, Seoul (KR); Seonil Yu, Seoul (KR); Hongsik Kwon, Seoul (KR); Sanghun Kim, Seoul (KR); Kyungsoo Park, Seoul (KR); Wonjun Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 267 days.

(21) Appl. No.: 16/660,079

(22) Filed: Oct. 22, 2019

(65) Prior Publication Data

US 2020/0124338 A1 Apr. 23, 2020

(30) Foreign Application Priority Data

Oct. 22, 2018 (KR) ..... 10-2018-0126290

(51) Int. Cl.
*F25D 17/06* (2006.01)
*F25D 23/02* (2006.01)

(52) U.S. Cl.
CPC ..... *F25D 17/062* (2013.01); *F25D 23/028* (2013.01); *F25D 2317/062* (2013.01); *F25D 2317/0665* (2013.01)

(58) Field of Classification Search
CPC ..... F25D 17/062; F25D 23/028; F25D 2317/062; F25D 2317/0665; F25D 23/025; F25D 23/023; F25D 17/06; F25D 17/045; F25B 39/02
See application file for complete search history.

(56) References Cited

U.S. PATENT DOCUMENTS 4,379,391 A * 4/1983 Rhee ..... F25D 23/023 62/255
5,765,388 A * 6/1998 Jeon ..... F25D 23/025 62/408
5,784,895 A * 7/1998 Choi ..... A47F 3/0447 62/256
5,809,799 A * 9/1998 Jeon ..... A47F 3/0447 454/193
5,826,441 A * 10/1998 Oh ..... F25D 17/065 62/256
5,941,087 A * 8/1999 Lee ..... F25D 17/045 62/256
6,038,880 A * 3/2000 Oh ..... F24F 9/00 62/256
6,041,616 A * 3/2000 Jeong ..... F25D 23/023 62/419
2017/0045260 A1* 2/2017 Luo ..... F24F 13/1486

FOREIGN PATENT DOCUMENTS

KR 20000034208 A * 6/2000

* cited by examiner

*Primary Examiner* — Len Tran
*Assistant Examiner* — Dae Hyun Jin
(74) *Attorney, Agent, or Firm* — Fish & Richardson P.C.

(57) ABSTRACT

A refrigerator includes a cold air supply device configured to generate an air curtain and disposed on an upper surface of the refrigerator. The cold air supply device includes a shielding module configured to selectively cover or open an air curtain hole supplying air to form the air curtain based on a door of the refrigerator being closed or opened.

20 Claims, 8 Drawing Sheets

REFRIGERATOR

CROSS-REFERENCE TO RELATED APPLICATIONS

The present application claims the benefits of priority to Korean Patent Application No. 10-2018-0126290 filed on Oct. 22, 2018, which is herein incorporated by reference in its entirety.

BACKGROUND

The present disclosure relates to a refrigerator.

Refrigerators are devices for storing foods at a low temperature.

In some examples, the refrigerator may include a refrigerating compartment, a freezing compartment, and a door for opening or closing the refrigerating compartment and the freezing compartment. A user may open the door to take food stored in the refrigerating compartment and the freezing compartment, and close the door to store food in the refrigerating compartment and the freezing compartment.

In some cases, the refrigerator may form an air curtain on the entire surface of the refrigerator to prevent cold air inside the refrigerator from flowing out to the outside when the refrigerator door is opened and to prevent outside hot air from entering into the inside of the refrigerator.

In some cases, the refrigerator may include a cold air duct that extends from an evaporator provided on a rear side of the refrigerator along the rear side of the refrigerator and the ceiling. In some cases, where a discharge port is formed a front end of an upper side of the refrigerator, cold air may be blown down through the discharge port when a refrigerator door is opened.

In some cases, where the refrigerator forms the air curtain, a flow path for movement of cold air may be formed in the inside of the main body of the refrigerator, for example, between an inner case and an outer case, or on the inner circumferential surface of the inner case.

In some cases, as a thickness of the refrigerator decreases, heat insulating performance may be deteriorated.

In some cases, where a cold air flow path structure is additionally provided, the design structure of the main body of the refrigerator may become complicated.

In some cases, the volume of the storage space may be reduced as much as the volume of the cold air flow path for the air curtain formed inside the main body of the refrigerator.

SUMMARY

According to one aspect of the subject matter described in this application, a refrigerator include: a main body that defines a storage compartment configured to store one or more objects; a door connected to the main body and configured to open and close at least a portion of the storage compartment; and a cold air supply device disposed on an upper surface of the main body and configured to supply cold air for generating an air curtain in front of the storage compartment. The cold air supply device includes: a housing that defines a suction grille disposed at a rear surface of the housing and configured to receive air; a blowing fan assembly disposed in an inner front side of the housing, where the blowing fan assembly includes a fan housing that defines a cold air discharge port and an air curtain hole, a blowing fan accommodated in the fan housing, and a fan motor configured to drive the blowing fan; a shielding module disposed inside the fan housing at a position vertically below the blowing fan and configured to selectively cover the cold air discharge port or the air curtain hole; and an air curtain switch that is connected to one side of the shielding module, that protrudes from a bottom surface of the housing toward an upper surface the door, and that is configured to move relative to the housing. The air curtain switch is configured to: based on the door being closed, be pressed by the upper surface of the door and move upward toward the bottom surface of the housing; and based on the door being opened, be separated from the upper surface of the door and move downward from the bottom surface of the housing. The shielding module is configured to, based on movement of the air curtain switch relative the housing, operate to cover one of the cold air discharge port or the air curtain hole and to open the other of the cold air discharge port or the air curtain hole.

Implementations according to this aspect may include one or more of the following features. For example, the fan housing may define a suction port at a rear side of the fan housing, where the air curtain hole may be defined at a lower side of the fan housing, and the cold air discharge port may be defined at the lower side of the fan housing at a position forward of the air curtain hole.

In some examples, the shielding module may include: a shielding plate configured to selectively cover the air curtain hole or the cold air discharge port; a pair of rotation guides disposed at both side ends of the shielding plate, respectively; a shaft that connects centers of the pair of rotation guides to each other, the shielding plate being configured to rotate about the shaft; a pinion coupled to a center of an outer surface of one of the pair of rotation guides; and a rack comprising a gear portion engaged with the pinion and a lower end coupled to the air curtain switch. The rack may be configured to move upward and downward relative to the housing based on rotating directions of the air curtain switch.

In some implementations, the refrigerator may further include a spring disposed on an upper end of the rack.

In some implementations, the air curtain switch may include: a door contact portion that extends downward toward the upper surface of the door, that has a round shape convex toward the upper surface of the door, and that is configured to contact the upper surface of the door; a rotational shaft that extends in a width direction of the door contact portion toward the rack and that is disposed at one of a front end of the door contact portion or a rear end of the door contact portion; a side plate that extends vertically from a side end of the door contact portion; and a guide shaft that extends horizontally from the side plate toward the rack. The guide shaft may extend parallel to the rotational shaft and is vertically spaced apart from the rotational shaft.

In some examples, the door contact portion may extend from the side plate in the width direction to thereby define a space that accommodates the lower end of the rack, and the rack may define an elongated guide hole disposed at the lower end of the rack and configured to receive the guide shaft.

In some implementations, the fan housing may include: a first stepped portion disposed at a first surface of the fan housing defining a rear end of the air curtain hole, where the first stepped portion is configured to receive a first end of the shielding plate based on rotation of the shielding plate in a first direction; and a second stepped portion disposed at a second surface of the fan housing defining an upper end of the cold air discharge port, where the second stepped portion is configured to receive a second end of the shielding plate based on rotation of the shielding plate in a second direction opposite the first direction.

In some implementations, the cold air supply device may further include a plurality of air vanes that face the air curtain hole and that are spaced apart from each other in a front-rear direction of the housing. In some examples, a pair of adjacent air vanes of the plurality of air vanes may define a cold air discharge passage configured to receive cold air from the air curtain hole and discharge cold air to generate the air curtain, where a cross-sectional area of an upper end of the cold air discharge passage may be greater than a cross-sectional area of a lower end of the cold air discharge passage.

In some implementations, the plurality of air vanes may include a first air vane and a second air vane that are disposed adjacent to each other in the front-rear direction of the housing, where the second air vane is disposed rearward of the first air vane. A rear surface of the first air vane may be inclined rearward and define a first angle with respect to a vertical plane.

In some examples, a front surface of the second air vane may extend in parallel to the vertical plane. In some examples, a front surface of the second air vane may be inclined rearward and define a second angle with respect to the vertical plane, where the first angle is greater than the second angle.

In some implementations, the shaft may pass through one of the pair of rotation guides and be inserted into a center of the pinion.

In some implementations, the cold air supply device may further include a discharge grille disposed at a front surface of the housing and configured to guide cold air passing through the cold air discharge port in a forward direction. In some implementations, the refrigerator may further include an evaporator disposed inside the housing between the blowing fan and the rear surface of the housing and configured to cool air drawn toward the blowing fan through the suction grille.

In some implementations, the air curtain switch may be configured to: based on the door being closed, rotate upward toward the bottom surface of the housing; and based on the door being opened, rotate downward from the bottom surface of the housing. In some examples, the air curtain switch may have a first end rotatably coupled to the housing and a second end configured to be inserted into the housing based on the door being closed.

In some implementations, the shielding module may be configured to: based on a rotation of the air curtain switch from a first position in a first direction, cover the cold air discharge port and open the air curtain hole; and based on a rotation of the air curtain switch to the first position in a second direction opposite to the first direction, open the cold air discharge port and cover the air curtain hole.

In some implementations, the air curtain switch may be disposed at one of both lateral sides of the bottom surface of the housing and configured to be exposed to an outside of the housing based on the door being open.

In some examples, the shaft of the shielding module may extend parallel to the guide shaft and is vertically spaced apart from the guide shaft.

In some implementations, a device for forming an air curtain may be disposed at an external upper side of the refrigerator.

In some implementations, the refrigerator may include a cold air duct separately disposed along the inner circumferential surface of the refrigerator storage compartment to maintain the storage capacity in the refrigerator.

The details of one or more implementations are set forth in the accompanying drawings and the description below. Other features will be apparent from the description and drawings, and from the claims.

DETAILED DESCRIPTION

Hereinafter, the configuration and operation of a refrigerator will be described in detail with reference to the accompanying drawings.

Figure 1:
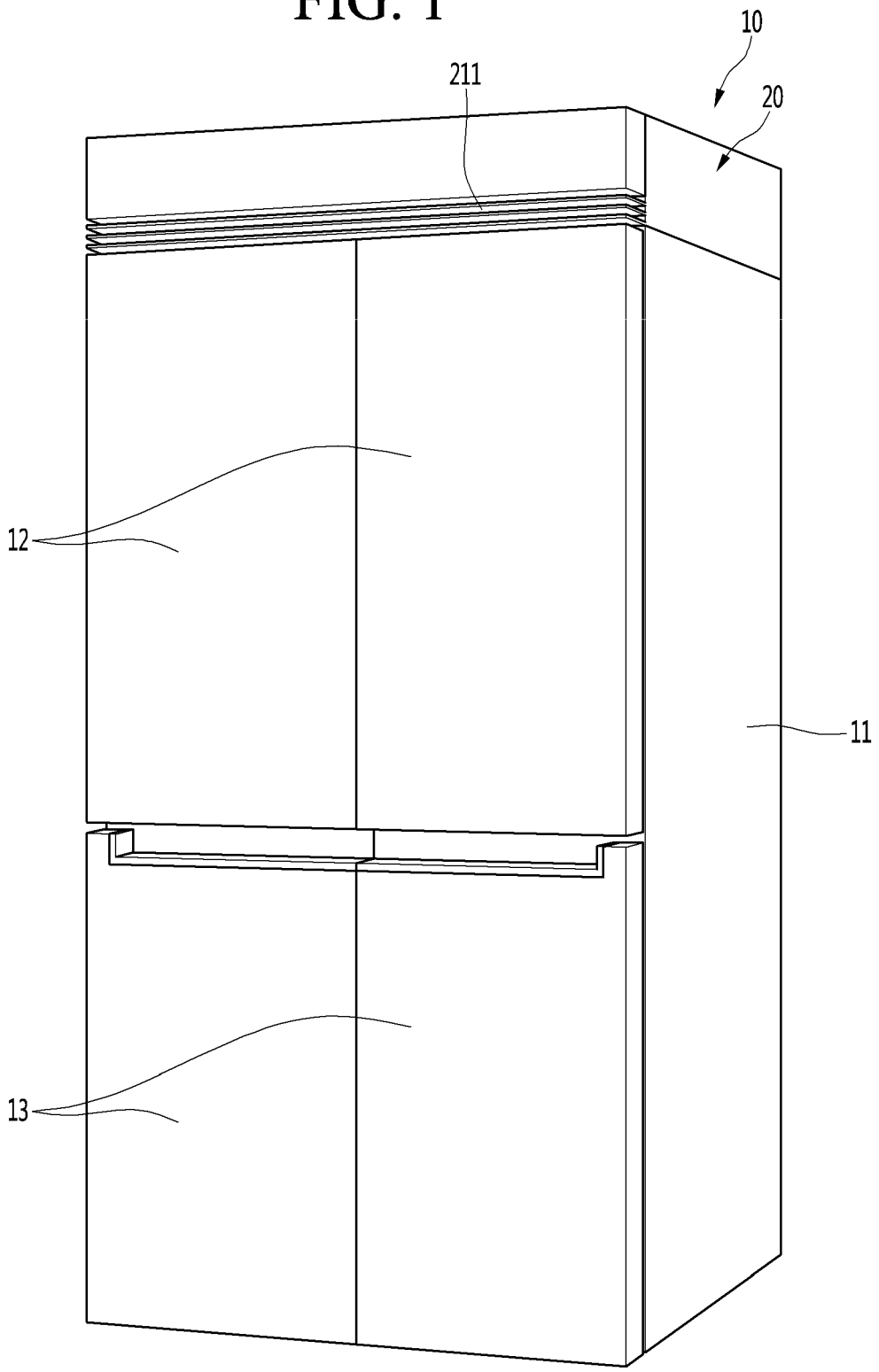
FIG. 1 is an overall perspective view of an example refrigerator.
Figure 2:
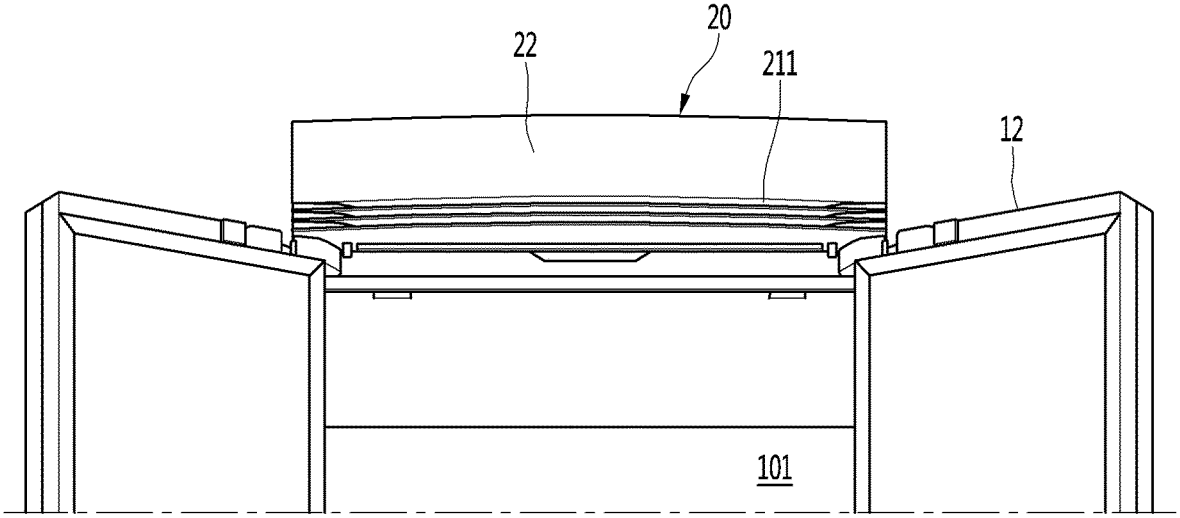
FIGS. 2 and 3 are enlarged partial perspective views showing example parts for performing an air curtain function.
Figure 3:
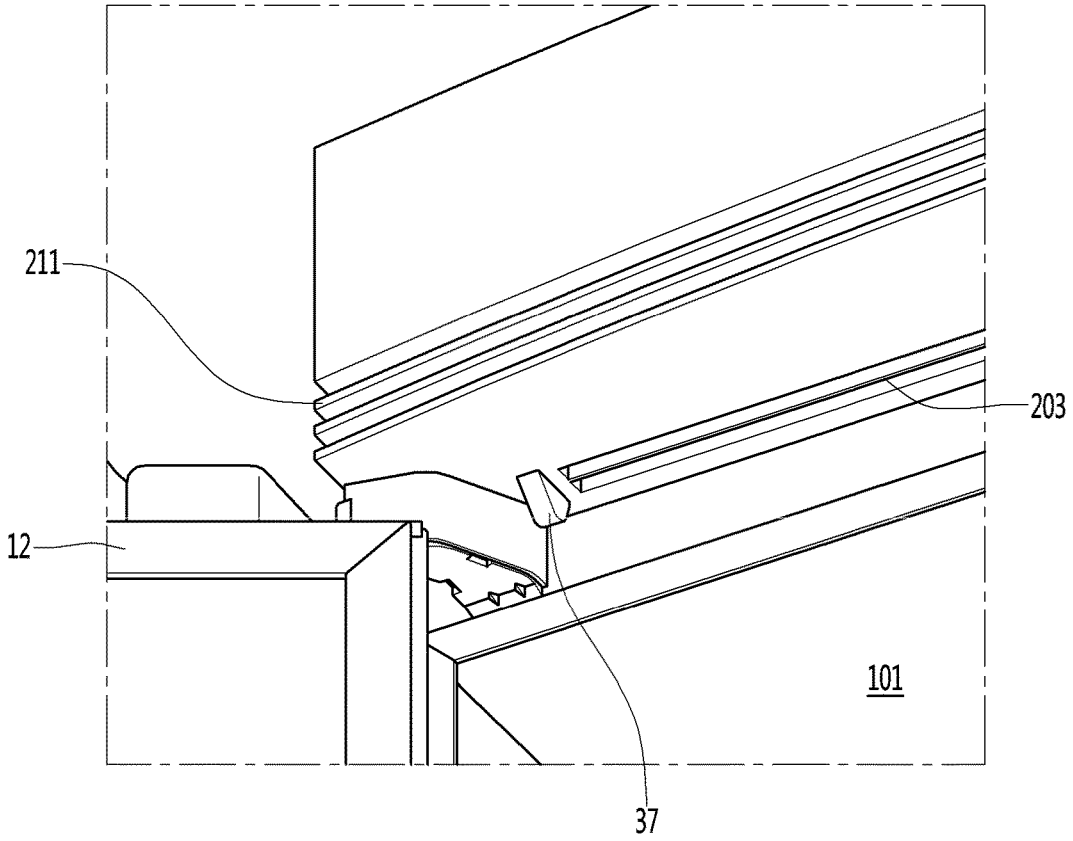

FIG. 1 is an overall perspective view of an example refrigerator, and FIGS. 2 and 3 are enlarged partial perspective views illustrating example parts for performing an air curtain function.

Referring to FIGS. 1 to 3, a refrigerator 10 includes a food storage part and a cold air supply part (or cold air supply device), which is coupled to the upper side of the food storage part and configured to generate an air curtain. In some examples, the cold air supply part or the cold air supply device may include an air conditioner 20.

In some implementations, the food storage part of the refrigerator 10 may include a main body 11 that defines a storage compartment including a refrigerating compartment 101 and/or a freezing compartment, and a door configured to selectively open and close at least a portion (e.g., front portion) of the storage compartment. In some examples, the door may include a refrigerating compartment door 12 for opening and closing the refrigerating compartment, and a freezing compartment door 13 for opening and closing the freezing compartment.

In some examples, the refrigerator 10 may include a machine room for accommodating a compressor, a condenser, and a condensing fan at a lower rear side of the main body 11. The refrigerator 10 may include an evaporation room for accommodating an evaporator on a rear surface of the main body 11. The main body 11 may include an outer case, an inner case, and a heat insulating material filled between the outer case and the inner case. The evaporation room for accommodating the evaporator may be defined at the rear surface of the inner case in a recessed shape. The front surface of the evaporation room may be shielded by a cover or a duct, and a cold air duct extends along the rear surface of the inner case.

In some implementations, the air conditioner 20 may be mounted on the upper surface of the main body 11, and an air curtain switch 37 may protrude from the bottom surface thereof. The air curtain switch 37 is pushed upward by the upper surface of the refrigerating compartment door 12 (which can be a freezing door in some implementations) and then protrudes downward when the refrigerating compartment door 12 is opened. The structure of the air curtain switch 37 and the operation relation of other configurations will be described in more detail with reference to the accompanying drawings.

In FIGS. 1 to 3, the air conditioner 20 may include a cold air discharge grille 211 and an air vane 203. These components will be described in detail below with reference to the accompanying drawings.

Figure 4:
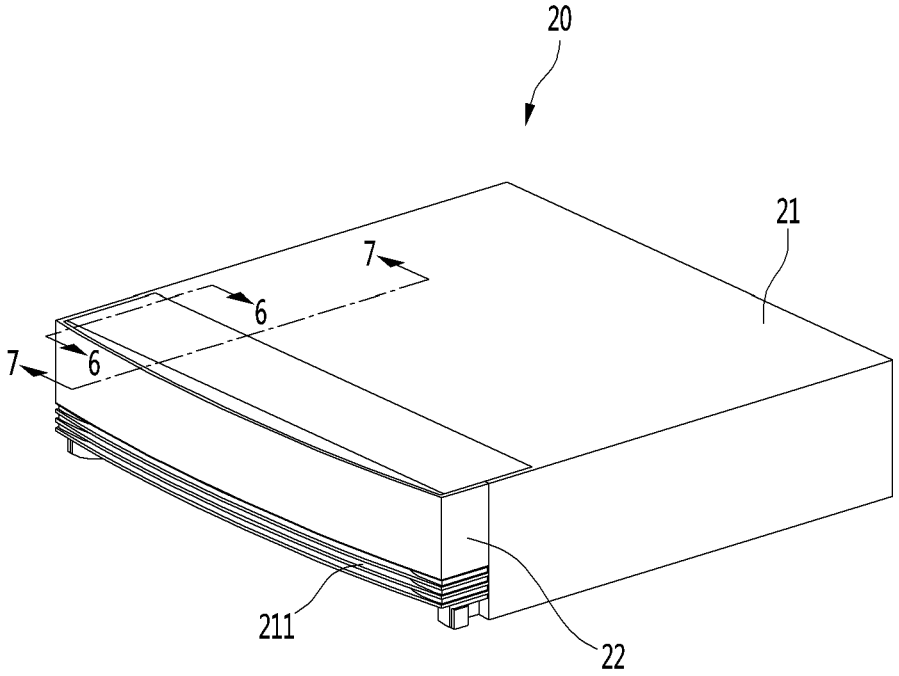
FIG. 4 is a perspective view showing an example of an air conditioner for generating an air curtain.
Figure 5:
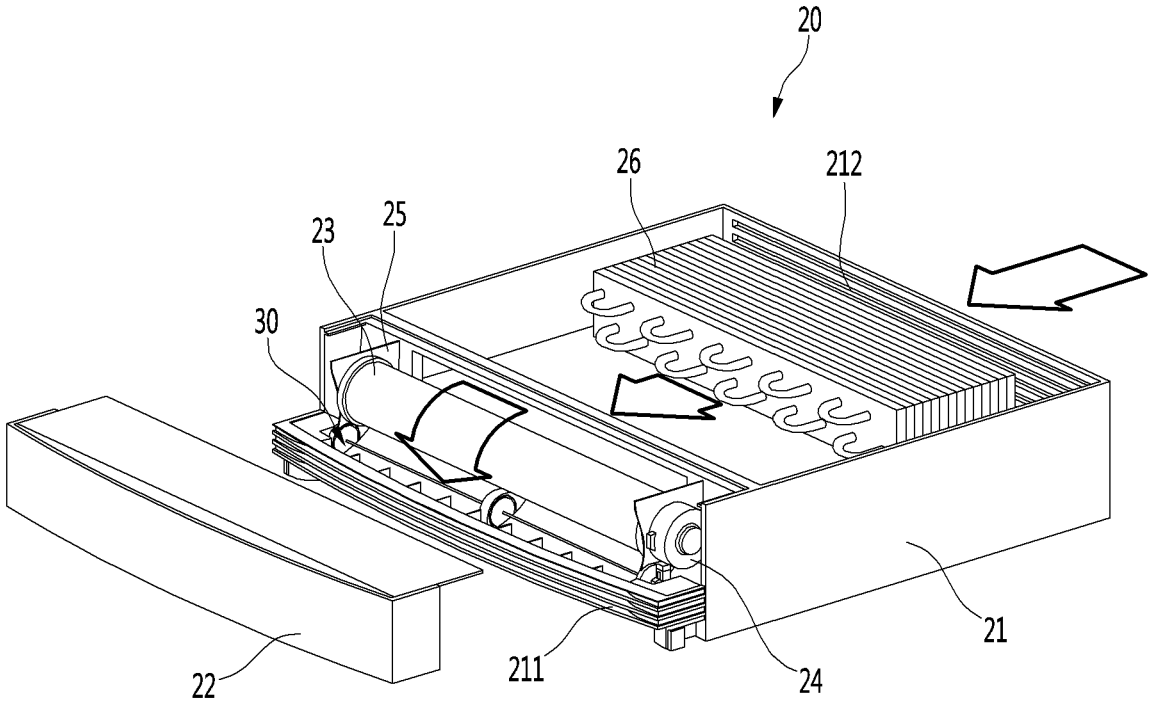
FIG. 5 is an exploded perspective view illustrating an example of an internal configuration of the air conditioner.

FIG. 4 is a perspective view showing an example of an air conditioner for generating an air curtain, and FIG. 5 is an exploded perspective view illustrating an example of an internal configuration of the air conditioner.

Referring to FIGS. 4 and 5, the air conditioner 20 includes a housing 21 and a front cover 22 coupled to the front surface of the housing 21 to define an outer appearance.

In some implementations, the cold air discharge grille 211 may be formed on the front lower side of the housing 21, and the front cover 22 may be placed on the upper side of the cold air discharge grille 211.

In some implementations, a suction grille 212 may be defined on the rear surface of the housing 21 such that air outside the air conditioner 20 may be introduced into the housing 21.

In some implementations, an evaporator 26 is installed inside the housing 21, and the evaporator 26 may be connected in parallel to a refrigerating compartment evaporator or a freezing compartment evaporator provided inside the main body 11 of the refrigerator 10. Alternatively or in addition, a separate cooling cycle including a compressor, a condenser, and an expansion valve may be provided in the housing 21.

An air blowing device or assembly including a blowing fan 23, a fan housing 25, and a fan motor 24 may be disposed at the front end of the housing 21. The air blowing device may be shielded by the front cover 22. The blowing fan 23 may include a sirocco fan.

In some implementations, a shielding module 30 may be mounted on the lower side of the blowing fan 23. The shielding module 30 selectively shields the cold air discharge port 252 and the air curtain hole 253 (see FIG. 8) formed on the front lower end and the bottom surface of the fan housing 25, respectively. Hereinafter, the structure of the shielding module 30 will be described with reference to the accompanying drawings.

Figure 6:
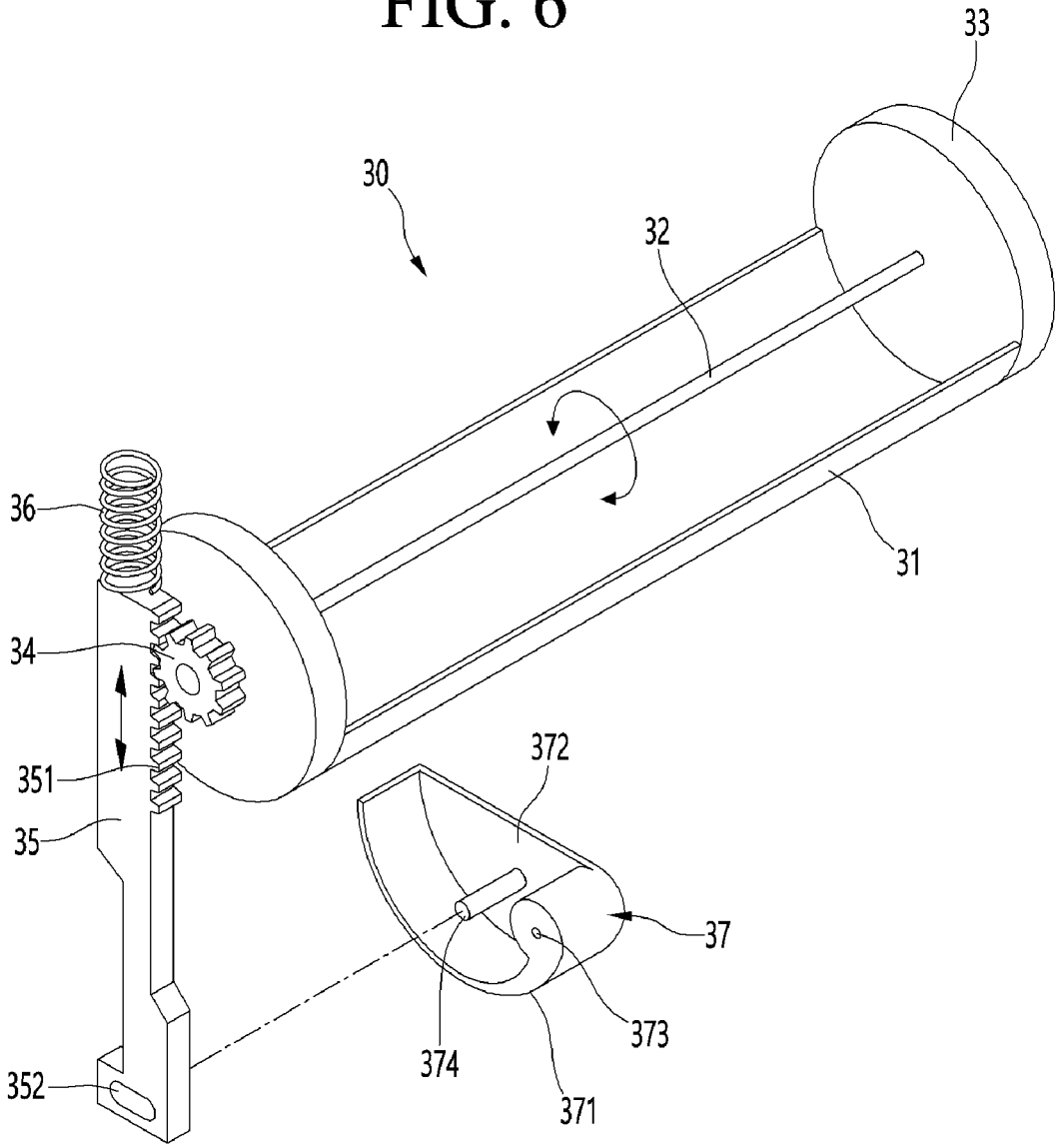
FIG. 6 is a perspective view illustrating an example of a configuration of a shielding module.

FIG. 6 is a perspective view illustrating an example configuration of the shielding module.

Referring to FIG. 6, the shielding module 30 may include a shielding plate 31, rotation guides 33 provided at both side ends of the shielding plate 31, a shaft 32 connecting the centers of the pair of rotation guides 33, a pinion 34 mounted on the center of the outer surface of one of the pair of rotation guides 33, a rack 35 gear-engaged with the pinion 34, an air curtain switch 37 coupled to the lower end of the rack 35, and a spring 36 disposed at the upper end of the rack 35.

The rotation guide 33 may have a disk shape, and the shielding plate 31 may extend a predetermined length in the circumferential direction of the rotation guide 33. A straight-line distance between both ends of the shielding plate 31 extending in the circumferential direction of the rotation guide 33 may be defined as the width of the rotation guide 33, and a straight-line distance between both ends of the shielding plate 31 extending from one of the pair of the rotation guides 33 to the other one may be defined as the length of the rotation guide 33.

The shaft 32 may be inserted into the center of the pinion 34 through the center of one of the pair of rotation guides 33, specifically, the rotation guide on which the pinion 34 is mounted.

In some implementations, the pinion 34 and the rotation guide 33 may be formed as one body. In some implementations, the pinion 34 may be bonded to the outer surface of the rotation guide 33.

In some examples, each of the pair of rotation guides 33 may have a circular plate, and the shielding plate 31 may connect the pair of rotation guides 33.

The outer circumferential surface of the shielding plate 31 may rounded to have the same curvature as the curvature of the rotation guide 33, and the inner circumferential surface of the shielding plate 31 may be formed to be flat or smoothly rounded. The maximum thickness portion of the shielding plate 31 may designed to be smaller than the radius of the rotation guide 33, such that the cross section may be a crescent shape. That is, the shaft 32 is spaced apart from the inner circumferential surface of the shielding plate 31 by a predetermined distance.

In some implementations, the shaft 32 may be coupled to the center of the pinion 34 through the rotation guide 33. Therefore, the shaft 32, the shielding plate 31, the rotation guide 33, and the pinion 34 rotate in one body.

In some implementations, the air curtain switch 37 may include a rear end portion at which the rotational shaft 373 is formed, a front end portion formed in front of the rear end portion, a door contact portion 371 connecting the rear end portion and the front end portion and formed to be rounded downward with a predetermined width, and a side plate 372 shielding one side of the door contact portion 371.

The other side of the door contact portion 371 is opened, and the guide shaft 374 extends from the side plate 372.

The door contact portion 371 is rounded in a hook shape as illustrated in the drawing, and the center portion of the door contact portion 371 is formed to be lower than the front and rear ends. Since the door contact portion 371 is formed to have a predetermined width, an accommodation space is formed therein by the side plate 372 and the door contact portion 371. The guide shaft 374 is placed in the accommodation space.

The lower end of the rack 35 is accommodated in the accommodation space, and a guide hole 352 having an elongated hole shape through which the guide shaft 374 is inserted is formed at the lower end of the rack 35. Therefore, when the air curtain switch 37 rotates about the rotational shaft 373, the guide shaft 374 moves along one end and the other end of the guide hole 352 and the rack 35 moves in the vertical direction.

In some implementations, a gear portion 351 may be disposed on the side surface of the upper end of the rack 35, and the gear portion 351 may be engaged with the pinion 34.

In some implementations, the spring 36 may be disposed at the upper end of the rack 35 and is contracted or expanded according to the upward or downward movement of the rack 35.

The shielding module 30, the cold air discharge port 252, and the air curtain hole 253 may be formed in the same number as the number of refrigerating chamber doors. That is, when the refrigerating compartment door 12 is a double door type, the pair of shielding modules, the cold air discharge port, and the air curtain hole may also be formed at the positions where the upper surface of the refrigerating compartment door is positioned.

Figure 7:
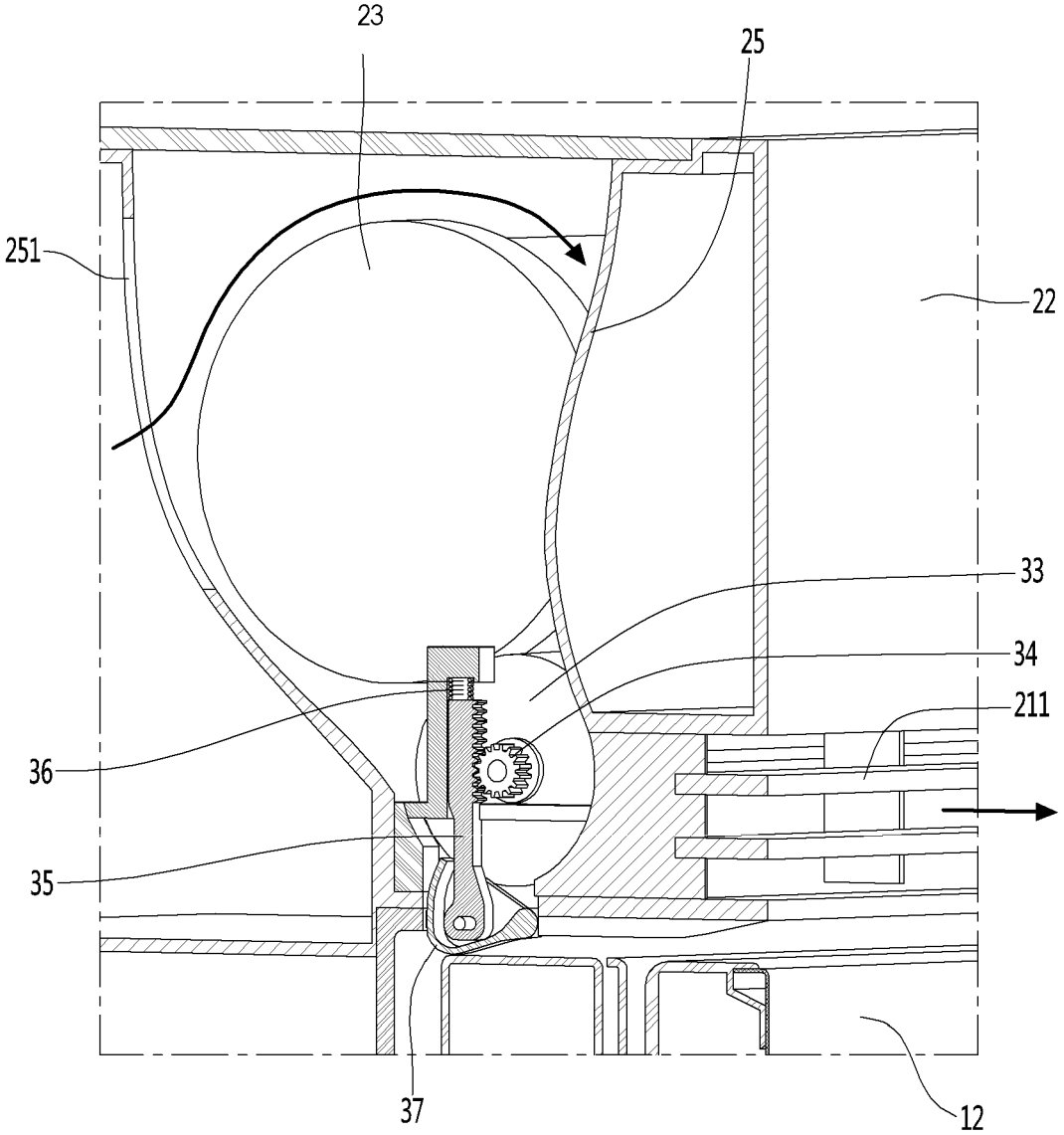
FIGS. 7 and 8 are a left side sectional view and a right side sectional view, respectively, illustrating an example of a shielding module and a cold air flow in a state in which a refrigerating compartment door is closed.
Figure 8:
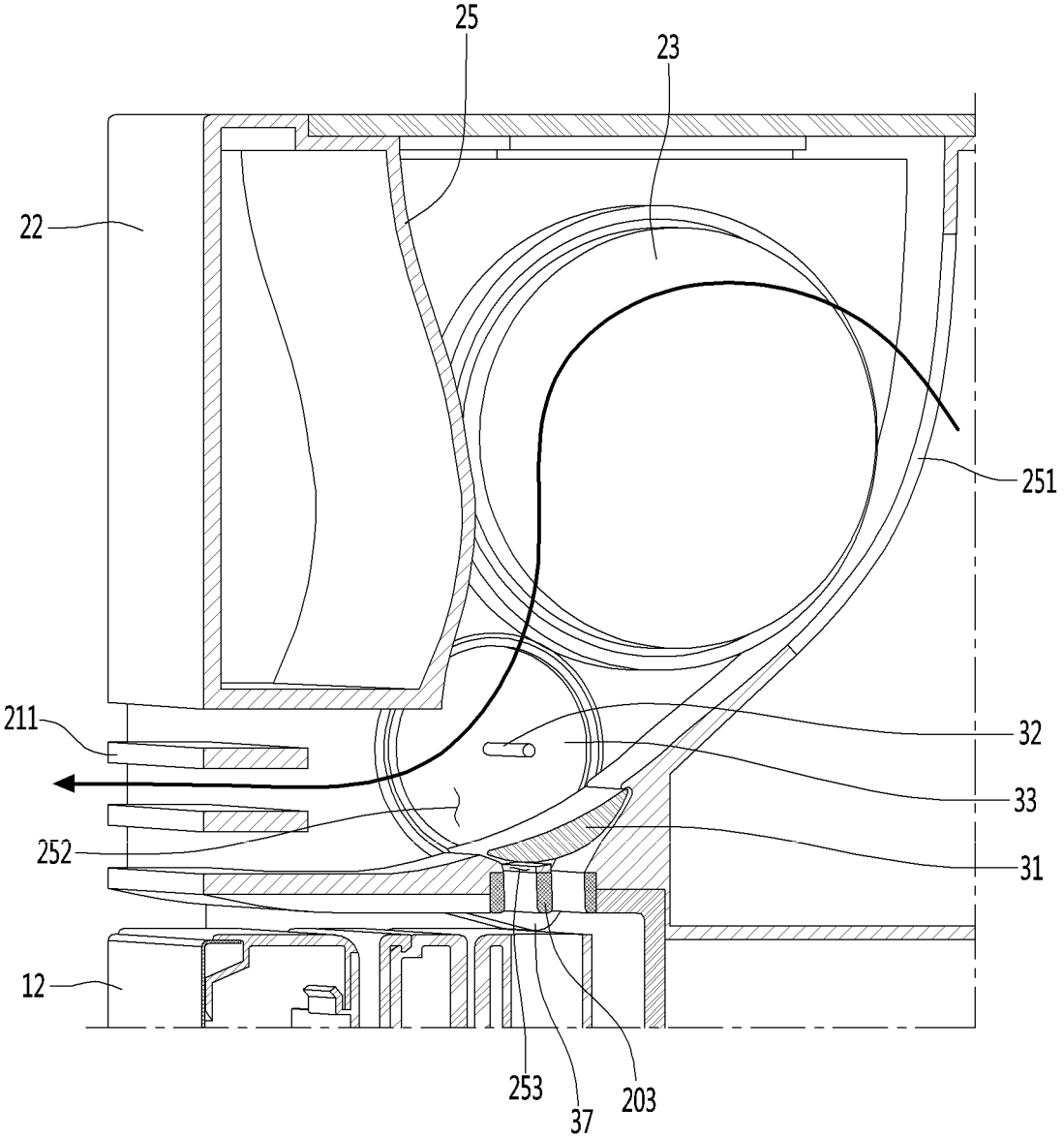

FIGS. 7 and 8 are a left side sectional view and a right side sectional view, respectively, illustrating an example of the shielding module and the cold air flow in a state in which the refrigerating chamber door is closed.

Referring to FIGS. 6 to 8, a suction port 251 is formed on the rear surface of the fan housing 25 in which the blowing fan 23 is accommodated, a cold air discharge port 252 is formed on the front lower end thereof, and the air curtain hole 253 is formed on the bottom surface thereof.

The shielding module 30 is accommodated in the lower region of the housing 21, such that the shielding plate 31 selectively shields the cold air discharge port 252 and the air curtain hole 253.

In some implementations, the cold air discharge port may be defined at the bottom surface of the housing 21 facing the upper surface of the refrigerating compartment door 12, and a plurality of air vanes 203 may be mounted on the cold air discharge port. In some examples, the cold air discharge grille 211 may be disposed in front of the cold air discharge port.

Hereinafter, a process of forming the air curtain by opening or closing the refrigerating compartment door 12 in a state in which the air conditioner 20 is operating will be described.

First, when the refrigerating compartment door 12 is closed, the upper surface of the refrigerating compartment door 12 presses the door contact portion 371. Therefore, the door contact portion 371 rotates about the rotational shaft 373 clockwise (with reference to FIG. 6).

When the air curtain switch 37 rotates upward, the guide shaft 374 also rotates upward and relatively moves from one end to the other end of the guide hole 352.

As the guide shaft 374 moves upward while rotating about the rotational shaft 373, the rack 35 also moves upward. When the rack 35 moves upward, the pinion 34 engaged with the gear portion 351 rotates clockwise in FIG. 6.

As the pinion 34 rotates, the shielding plate 31 also rotates and moves to a position for shielding the air curtain hole 253 in a state in which the cold air discharge port 252 is opened. That is, the cold air discharge port 252 is opened, and the air curtain hole 253 is shielded.

In this state, the air introduced into the housing 21 through the suction grille 212 is cooled while passing through the evaporator 26, and then is discharged to the room through the cold air discharge port 252.

The cold air discharged to the cold air discharge port 252 may be guided in the discharge direction by the cold air discharge grille 211.

Figure 9:
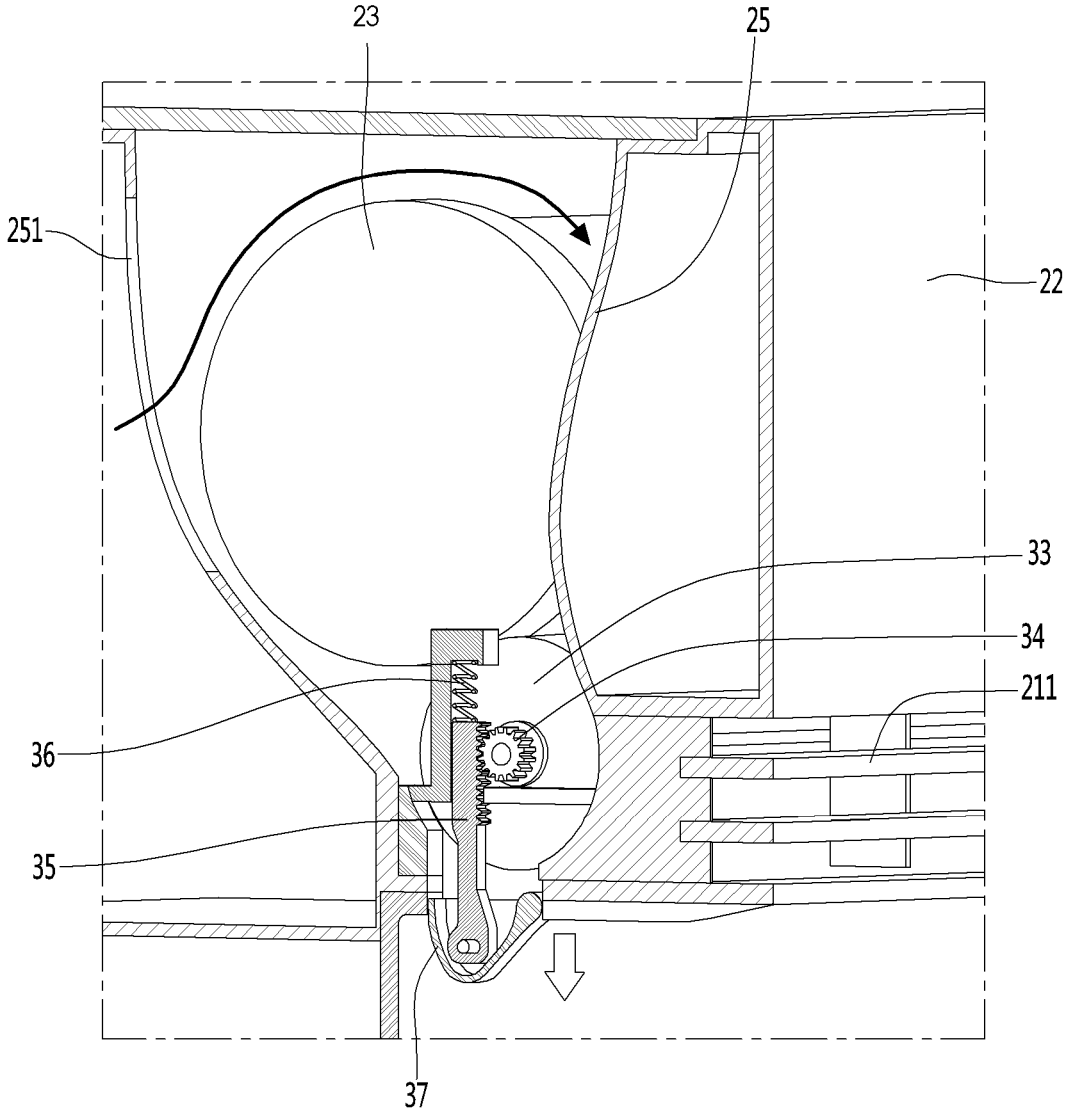
FIGS. 9 and 10 are a left side sectional view and a right side sectional view, respectively, illustrating an example of a shielding module and a cold air flow in a state in which a refrigerating compartment door is opened.
Figure 10:
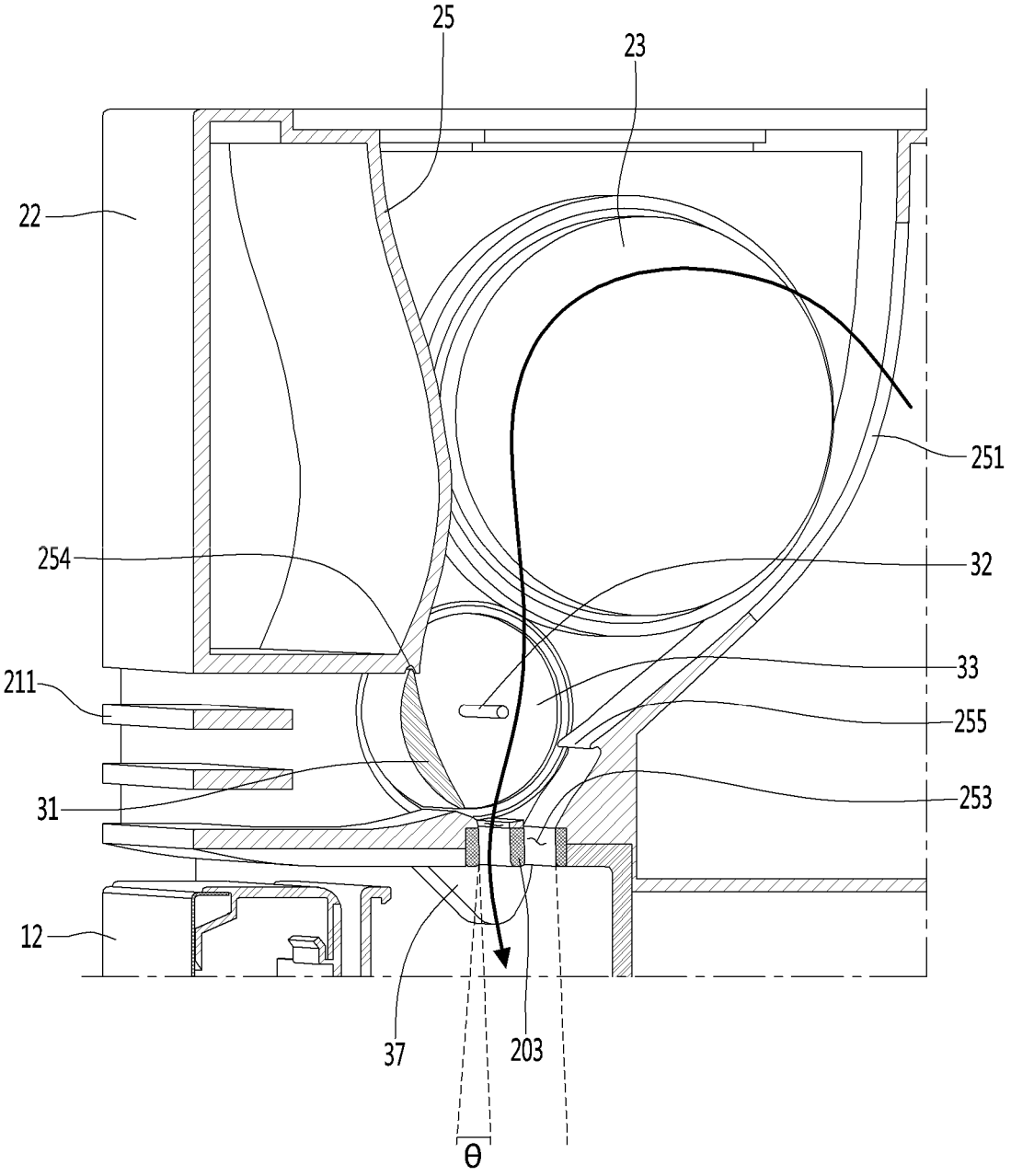

FIGS. 9 and 10 are a left side sectional view and a right side sectional view, respectively, illustrating an example of a shielding module and the cold air flow in a state in which the refrigerating chamber door is opened.

Referring to FIGS. 9 and 10, when the refrigerating compartment door 12 is opened, the air curtain switch 37 moves downward while rotating about the rotational shaft 373 counterclockwise.

In detail, when the air curtain switch 37 rotates counterclockwise, the guide shaft 374 rotates in a descending direction. As the guide shaft 374 moves downward, the rack 35 also moves downward. As the rack 35 moves downward, the pinion 34 engaged with the gear portion 351 rotates counterclockwise.

The shielding plate 31 rotates in a direction in which the cold air discharge port 252 is shielded in a state of shielding the air curtain hole 253 to open the air curtain hole 253.

The cold air introduced into the fan housing 25 is sprayed downward from the front surface of the main body 11 of the refrigerator through the air curtain hole 253 to block indoor air from entering into the inside of the refrigerating chamber.

In some implementations, the front and rear surfaces of the air vane 203 may be inclined at a predetermined angle θ from the vertical plane to the rear side, such that the air curtain may be formed to be slightly inclined toward the front of the refrigerating chamber. In other words, due to the inclination of the front and rear surfaces of the air vane 203, the air curtain may be inclined in a direction toward the inside of the refrigerating compartment rather than the outside of the refrigerating compartment.

In some implementations, among the pair of air vanes facing each other, the back surface of the air vane positioned forward may be formed to be inclined rearward from the vertical plane by a predetermined angle θ, and the front surface of the air vane positioned behind may be formed to be inclined at a predetermined angle θ vertically or rearward from the vertical plane.

In some implementations, the cross-sectional area of the lower end of the cold air discharge passage formed between the adjacent air vanes 203 in the front-rear direction may be narrower than the cross-sectional area of the upper end of the cold air discharge passage. Thus, the cold air passing through the air curtain hole 253 may be discharged at a high speed.

In some examples, the back surface of the front air vane may be formed to be inclined rearward, and the front surface of the rear air vane may be formed vertically.

In some implementations, the front and rear surfaces of the air vane are all inclined rearward from the vertical plane. The angle θ1 formed by the back surface of the front air vane and the vertical surface may be formed to be larger than the angle (θ2>0) formed by the front surface of the rear air vane and the vertical surface.

In some implementations, one end portion and the other end portion of the shielding plate 31 in the width direction are respectively inserted into a stepped portion 255 formed at the rear end of the air curtain hole 253 and a stepped portion 254 formed at the upper end of the cold air discharge port 252.

That is, in a state in which the shielding plate 31 shields the air curtain hole 253, one end of the shielding plate 31 in the width direction is inserted into the stepped portion 255 formed at the rear end of the air curtain hole 253, thereby minimizing leakage of cold air.

In a state in which the shielding plate 31 shields the cold air discharge port 252, the other end of the shielding plate 31 in the width direction is inserted into the stepped portion 254 formed at the upper end of the cold air discharge port 252, thereby minimizing leakage of cold air.

In some implementations, the spring 36 may not be required for the operation of the shielding module 30. In detail, when the refrigerating compartment door is opened, the rack 35 and the air curtain switch 37 may be lowered by gravity, such that the shielding plate 31 may be sufficiently rotated without the assistance of the spring 36. In some implementations, the spring 36 may be omitted. In some implementations, the spring 36 may be added to help provide a more stable operation of the shielding module 30.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a main body that defines a storage compartment configured to store one or more objects;

a door connected to the main body and configured to open and close at least a portion of the storage compartment; and a cold air supply device mounted on an outer upper surface of the main body and configured to supply cold air for generating an air curtain at a position forward relative to a front surface of the storage compartment, wherein the cold air supply device comprises:

a housing that is mounted on the outer upper surface of the main body and defines a suction grille at a rear surface thereof, an evaporator disposed inside the housing and configured to cool indoor air that is introduced from an area outside the storage compartment into the housing through the suction grille to thereby generate the cold air, a blowing fan assembly disposed in an inner front side of the housing and configured to draw the indoor air in the area outside the storage compartment into the housing, the blowing fan assembly comprising:

a fan housing that defines (i) cold air discharge port configured to discharge the cold air forward to a space where the refrigerator is installed based on the door being in a closed position, and (ii) an air curtain hole configured to discharge the cold air downward based on the door being in an opened position, a blowing fan accommodated in the fan housing, and a fan motor configured to drive the blowing fan, the evaporator being disposed between the blowing fan and the rear surface of the housing, a shielding module disposed inside the fan housing at a position below the blowing fan, the shielding module being configured to selectively cover the cold air discharge port or the air curtain hole, and an air curtain switch that is connected to one side of the shielding module, that protrudes from a bottom surface of the housing toward an uppermost surface of the door, and that is configured to move relative to the housing, wherein the air curtain switch is configured to:

based on the door being closed, be pressed by the uppermost surface of the door and move upward toward the bottom surface of the housing, and based on the door being opened, be separated from the uppermost surface of the door and move downward from the bottom surface of the housing, and wherein the shielding module is configured to:

based on the door being closed, cover the air curtain hole and open the cold air discharge port such that the cold air is forwardly discharged to the space where the refrigerator is installed, and based on the door being opened, cover the air curtain hole and cover the cold air discharge port such that the cold air is vertically discharged, and wherein the air curtain hole is defined at a position above the uppermost surface of the door in the closed position and forward relative to the front surface of the storage compartment.

2. The refrigerator according to claim 1, wherein the fan housing defines a suction port at a rear side of the fan housing, wherein the air curtain hole is defined at a lower side of the fan housing, and wherein the cold air discharge port is defined at the lower side of the fan housing at a position forward of the air curtain hole.

3. The refrigerator according to claim 2, wherein the shielding module comprises:

a shielding plate configured to selectively cover the air curtain hole or the cold air discharge port;

a pair of rotation guides disposed at both side ends of the shielding plate, respectively;

a shaft that connects centers of the pair of rotation guides to each other, the shielding plate being configured to rotate about the shaft;

a pinion coupled to a center of an outer surface of one of the pair of rotation guides; and a rack comprising a gear portion engaged with the pinion and a lower end coupled to the air curtain switch, and wherein the rack is configured to move upward and downward relative to the housing based on rotating directions of the air curtain switch.

4. The refrigerator according to claim 3, further comprising a spring disposed on an upper end of the rack.

5. The refrigerator according to claim 3, wherein the air curtain switch comprises:

a door contact portion that extends downward toward the upper surface of the door, that has a round shape convex toward the upper surface of the door, and that is configured to contact the upper surface of the door;

a rotational shaft that extends in a width direction of the door contact portion toward the rack and that is disposed at one of a front end of the door contact portion or a rear end of the door contact portion;

a side plate that extends vertically from a side end of the door contact portion; and a guide shaft that extends horizontally from the side plate toward the rack, and wherein the guide shaft extends parallel to the rotational shaft and is vertically spaced apart from the rotational shaft.

6. The refrigerator according to claim 5, wherein the door contact portion extends from the side plate in the width direction to thereby define a space that accommodates the lower end of the rack, and wherein the rack defines an elongated guide hole disposed at the lower end of the rack and configured to receive the guide shaft.

7. The refrigerator according to claim 5, wherein the fan housing comprises:

a first stepped portion disposed at a first surface of the fan housing defining a rear end of the air curtain hole, the first stepped portion being configured to receive a first end of the shielding plate based on rotation of the shielding plate in a first direction, and a second stepped portion disposed at a second surface of the fan housing defining an upper end of the cold air discharge port, the second stepped portion being configured to receive a second end of the shielding plate based on rotation of the shielding plate in a second direction opposite the first direction.

8. The refrigerator according to claim 5, wherein the cold air supply device further comprises a plurality of air vanes that face the air curtain hole and that are spaced apart from each other in a front-rear direction of the housing.

9. The refrigerator according to claim 8, wherein a pair of adjacent air vanes of the plurality of air vanes define a cold air discharge passage configured to receive cold air from the air curtain hole and discharge cold air to generate the air curtain, and wherein a cross-sectional area of an upper end of the cold air discharge passage is greater than a cross-sectional area of a lower end of the cold air discharge passage.

10. The refrigerator according to claim 8, wherein the plurality of air vanes comprise a first air vane and a second air vane that are disposed adjacent to each other in the front-rear direction of the housing, the second air vane being disposed rearward of the first air vane, and wherein a rear surface of the first air vane is inclined rearward and defines a first angle with respect to a vertical plane.

11. The refrigerator according to claim 10, wherein a front surface of the second air vane extends in parallel to the vertical plane.

12. The refrigerator according to claim 10, wherein a front surface of the second air vane is inclined rearward and defines a second angle with respect to the vertical plane, and wherein the first angle is greater than the second angle.

13. The refrigerator according to claim 3, wherein the shaft passes through one of the pair of rotation guides and is inserted into a center of the pinion.

14. The refrigerator according to claim 1, wherein the cold air supply device further comprises a discharge grille disposed at a front surface of the housing and configured to guide cold air passing through the cold air discharge port in a forward direction.

15. The refrigerator according to claim 1, wherein the air curtain switch is configured to:

based on the door being closed, rotate upward toward the bottom surface of the housing; and based on the door being opened, rotate downward from the bottom surface of the housing.

16. The refrigerator according to claim 15, wherein the shielding module is configured to:

based on a rotation of the air curtain switch from a first position in a first direction, cover the cold air discharge port and open the air curtain hole; and based on a rotation of the air curtain switch to the first position in a second direction opposite to the first direction, open the cold air discharge port and cover the air curtain hole.

17. The refrigerator according to claim 15, wherein the air curtain switch has a first end rotatably coupled to the housing and a second end configured to be inserted into the housing based on the door being closed.

18. The refrigerator according to claim 1, wherein the air curtain switch is disposed at one of both lateral sides of the bottom surface of the housing and configured to be exposed to an outside of the housing based on the door being open.

19. The refrigerator according to claim 5, wherein the shaft of the shielding module extends parallel to the guide shaft and is vertically spaced apart from the guide shaft.

20. The refrigerator according to claim 1, wherein the cold air discharge port is open to a front surface of the housing facing the space where the refrigerator is installed, wherein the air curtain hole is open to the bottom surface of the housing facing the uppermost surface of the door, and wherein the air curtain switch is located at the bottom surface of the housing and forward relative to the front surface of the storage compartment.

* * * * *